US006520854B1

(12) United States Patent
McNally

(10) Patent No.: US 6,520,854 B1
(45) Date of Patent: Feb. 18, 2003

(54) ROULETTE WHEEL ASSEMBLY AND TABLE ARRANGEMENT

(75) Inventor: Gordon McNally, London (GB)

(73) Assignee: NRC Group Limited, Tortola (VG)

( * ) Notice: Subject to any disclaimer, the term of this patent is extended or adjusted under 35 U.S.C. 154(b) by 0 days.

(21) Appl. No.: 09/515,725

(22) Filed: Feb. 29, 2000

Related U.S. Application Data

(63) Continuation of application No. PCT/GB98/02599, filed on Aug. 28, 1998.

(51) Int. Cl.[7] ..... A63F 5/02

(52) U.S. Cl. ..... 463/17; 463/25; 273/142 R; 273/142 E; 273/142 B; 273/142 D

(58) Field of Search ..... 273/274, 142 R, 273/142 D–142 JD, 142 B; 463/17, 20, 25

(56) References Cited

U.S. PATENT DOCUMENTS

| | | | | |
|---|---|---|---|---|
| 4,337,945 A | | 7/1982 | Levy | 273/142 E |
| 4,735,416 A | | 4/1988 | McNally | 273/142 |
| 4,792,137 A | | 12/1988 | McKechnie | 273/138 A |
| 5,283,422 A | | 2/1994 | Storch et al. | 235/375 |
| 5,553,851 A | | 9/1996 | Malavazos et al. | 273/142 E |
| 5,588,650 A | | 12/1996 | Eman et al. | 273/142 B |
| 5,755,440 A | * | 5/1998 | Sher | |
| 6,083,105 A | * | 7/2000 | Ronin et al. | |

FOREIGN PATENT DOCUMENTS

| | | |
|---|---|---|
| EP | 0 269 331 A | 6/1988 |
| EP | 0 307 925 | 3/1989 |
| EP | 0763374 A1 | 3/1997 |
| JP | 8229191 | 10/1996 |

* cited by examiner

*Primary Examiner*—Benjamin H. Layno
(74) *Attorney, Agent, or Firm*—Fulbright & Jaworski L.L.P.

(57) ABSTRACT

A roulette wheel assembly and table arrangement includes a roulette wheel rotatably mounted in a wheel bowl, and driven by an electric motor. Thirty seven slot compartments are located around the wheel circumference to receive a roulette ball. In operation the wheel is rotated and the slot compartment floor is lowered to allow a ball from the previous game to be thrown outwardly and fall into a ball magazine. A firing breech is opened to allow a ball to enter a firing chamber. On the command, an air blower blows the ball into a firing tube which propels the ball tangentially onto the bowl in the opposite direction to the travel of the wheel. The ball travels across the bowl onto the wheel and finally lands in a compartment. Each player around the table has a betting station giving the betting choices that make up the game.

23 Claims, 10 Drawing Sheets

ROULETTE WHEEL ASSEMBLY AND TABLE ARRANGEMENT

This is a continuation application of PCT/GB98/02599, filed Aug. 28, 1998, the disclosure of which is incorporated herein by reference.

BACKGROUND OF THE INVENTION

The present invention relates to a roulette wheel assembly and table arrangement for playing what will be herein referred to as the real game of roulette.

SUMMARY OF THE INVENTION

In the real game of roulette the wheel has appropriately numbered and colored slot compartments around its circumference. The table is arranged so that there are 152 choices of bet that can be placed by each player.

It has previously been proposed to produce a machine for playing a fully automatic game of roulette which corresponds to the real game as played in casinos. The result of these proposals has been a range of machines which are merely video or electronic representations of the real game. These known machines are played using small amounts of money placed on a limited number of bets in comparison with the real game and table. These machines are suitable only for amusement arcades, and their design structure would not be suitable for use in a casino.

From European patent application No. 0269331 A2 is known a roulette wheel assembly including a roulette wheel 2 surrounded by a circular runway 4. A release opening 8 is located in a circular wall 6 located along the outer boundary of the runway 4. In operation the wheel 2 is rotated, a ball 20 is propelled through the opening 8 onto the runway 4 and finally settles into a slot compartment of the wheel 2. To release a ball 20 from a slot compartment the wheel 2 and drive motor 24 are lowered to allow the ball 20 to fall down a recovery member 30 and into a release device 32. The ball is then recycled along a release passage 34 to a hitting device 36 which propels the ball out through the release opening 8.

With this assembly it is necessary to lower the entire wheel 2 and drive motor 24 in order to release a ball 20 from a slot compartment.

U.S. Pat. No. 5,588,650 refers to an automated roulette game comprising a control means to control the rotation of a roulette wheel, a ball launching mechanism for releasing a ball into the roulette wheel for each spin, and an automatic ball return mechanism for resetting the ball for release by the ball launching mechanism. There is however no disclosure of how the ball is received by the ball return mechanism or of how the ball return mechanism operates.

It is an aim of the invention to enable the above-mentioned disadvantages of previously proposed machines to be alleviated.

According to one aspect of the present invention there is provided a roulette wheel assembly comprising a rotatable roulette wheel having a plurality of slot compartments around its circumference, a drive motor to rotate the roulette wheel, a firing mechanism to propel a roulette ball onto the rotating roulette wheel, which is shaped so that the ball finally lands in a slot compartment, and return mechanism to return the ball from the slot to the firing mechanism characterized in that the floor of the slot compartment is movable between a raised position to retain the ball in the slot compartment and a lowered position to allow the ball to be received by the return mechanism.

The drive motor may be operable to rotate the roulette wheel at a selected one of a range of speeds, and a constant drive pressure may be applied to the roulette wheel.

The firing mechanism may include a ball magazine, a firing tube and an air blower to propel the roulette ball through the firing tube and onto the roulette wheel. The air blower may be operable to produce a plurality of different ball firing air pressures.

In a preferred embodiment of the invention the return mechanism may include a collector channel to receive a ball form a slot compartment, and director means to direct the ball to the ball magazine. The ball magazine may be adapted to contain a plurality of balls of different weights. The action of lowering the slot compartment floor can also open the firing breech of the firing mechanism to enable a ball to enter.

A sensor mechanism may be provided to identify the slot compartment containing the roulette ball. This sensor mechanism may comprise a zero sensor to indicate when the roulette wheel is in the start position, a compartment sensor on a radial axis of the wheel to count the number of slot compartments passing the start position, a ball sensor on the same radial axis as the compartment sensor to detect when the ball is located on said radial axis, and electronic circuitry to compare the readings of said zero sensor and ball sensor.

According to another aspect of the present invention there is provided a roulette table arrangement including the above-mentioned roulette wheel assembly and at least one betting station containing a roulette betting layout.

The above-mentioned betting station may comprise two laminated materials mounted on a stiffening plate, and the lower laminate may comprise a printed contact circuit layout corresponding to the betting layout of the betting station. Raised domes representing at least some of the betting positions of the betting layout may be provided. These domes are positioned so that pressing a dome activates the printed circuit of the lower laminate to instruct a corresponding bet to be placed. The domes may be constructed so that the action of pressing a dome emits a sound indicating that a bet has been placed, and an amplifier may be provided to amplify the sound.

The roulette table arrangement may also include a video monitor to display a betting layout of a corresponding betting station and any bets placed thereon.

An electronic stake chip is provided for use with the above-mentioned roulette table arrangement. This chip includes an indicator providing a visual display of a player's financial credit. The roulette table arrangement may also include a credit head which is operable so that on placing the chip in electronic contact with a betting station, the chip provides a visual indication of a player's credit throughout the game.

In order to play the game of roulette using the above-mentioned roulette tale arrangement and electronic stake chip, the roulette player starts by paying his stake money to the casino cashier. The player is given a single casino chip with the value of the money paid shown on the chip indicator. The player then places the chip on the roulette table to make electronic contact with his belting station. After hearing the croupier's voice saying "place your bets please", the player presses the appropriate domes to select the slot compartment or compartments on which the player is betting.

All the bets placed are shown on a video monitor corresponding to the player's betting station. The stake chip will show on the video monitor and display the player's financial credit at that instant. The propelled roulette ball spins round the roulette wheel and lands in a slot compartment having an appropriate number, and the croupier announces the number. The bet winnings or losses will be added to or deducted from the stake chip and the resultant financial amount will be displayed on the chip indicator. The player can then commence placing more bets for the next game.

When the player decides to finish playing and to cash in his winnings, he takes the chip back to the cashier's window. The cashier checks the amount shown on the chip and pays out the appropriate amount of money.

One embodiment of the invention will now be described by way of example with reference to the accompanying illustrated drawings in which:

DETAILED DESCRIPTION OF THE PREFERRED EMBODIMENTS

Figure 1:
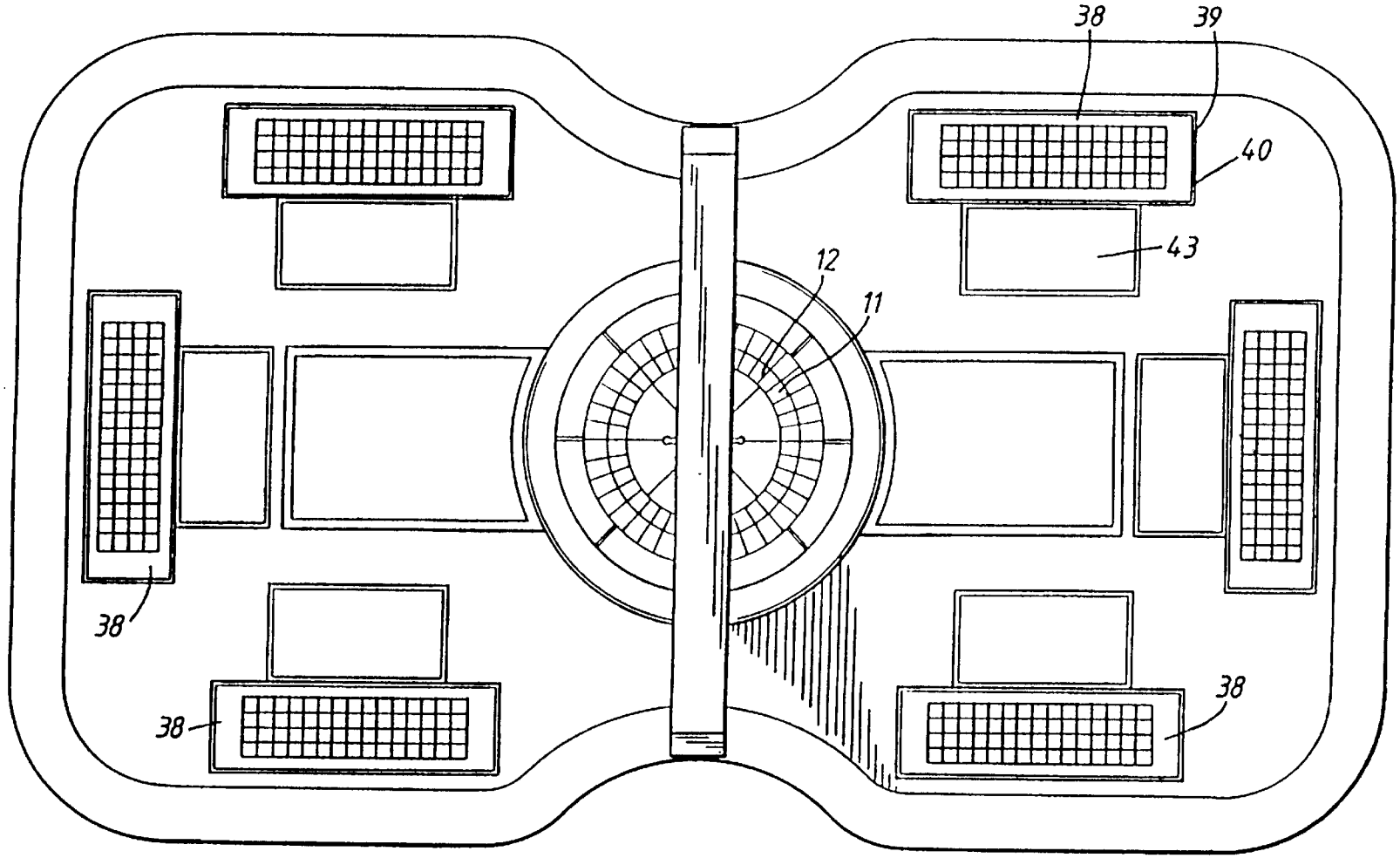
FIG. 1 is a plan view of a roulette table arrangement.
Figure 2:
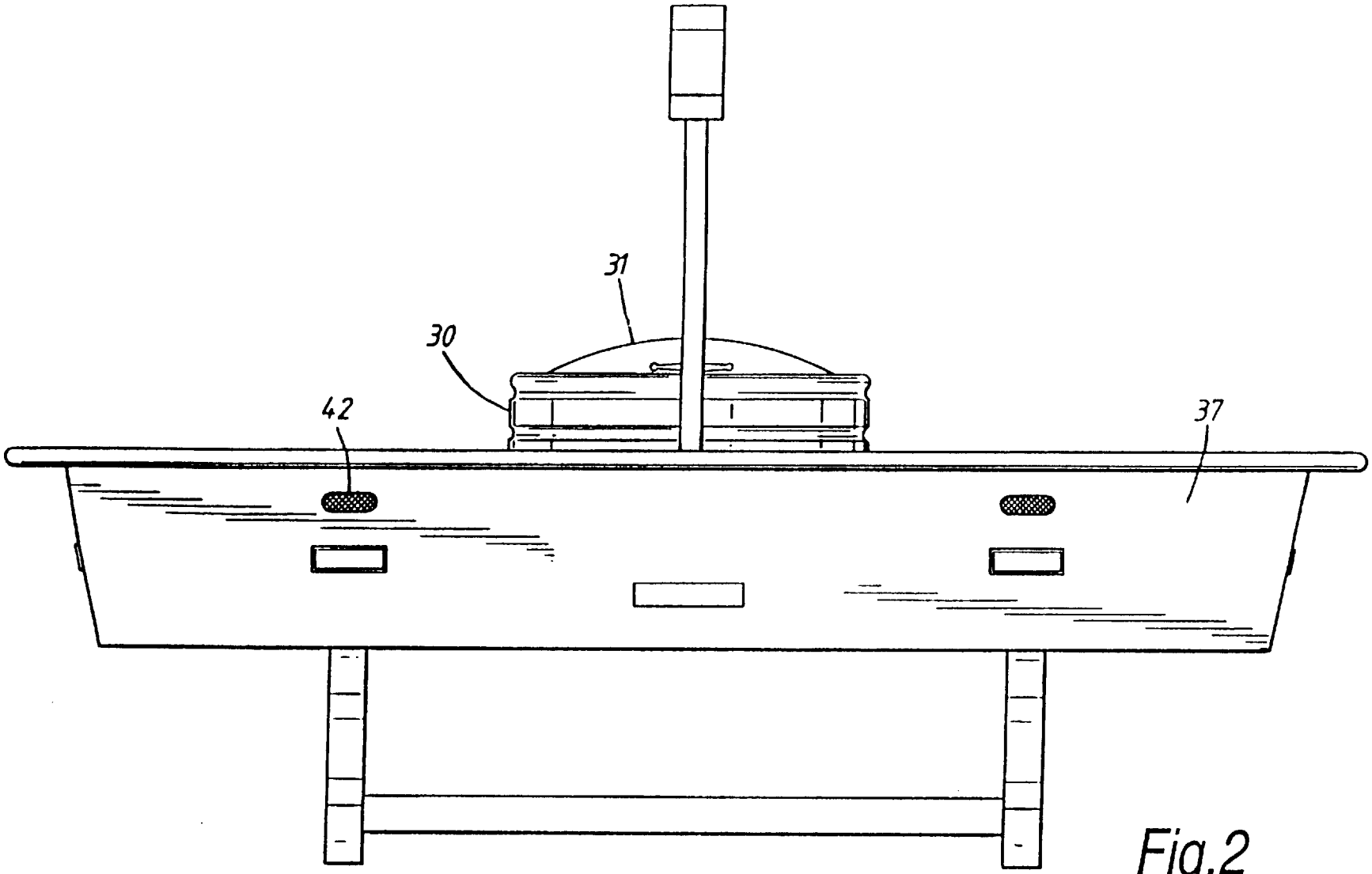
FIG. 2 is a side elevation of the roulette table arrangement of FIG. 1.
Figure 3:
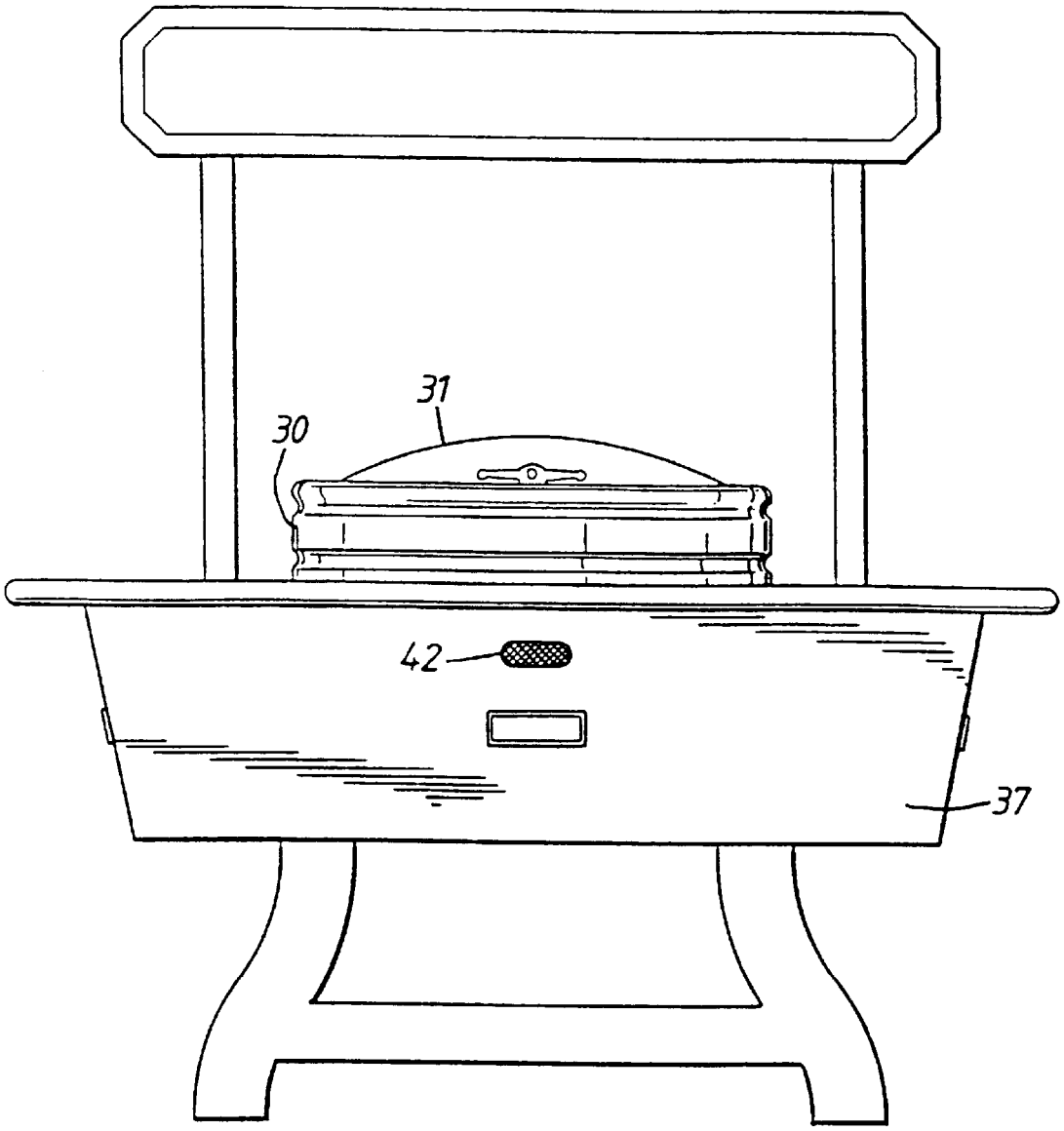
FIG. 3 is an end view of the roulette table arrangement of FIGS. 1 and 2.
Figure 4:
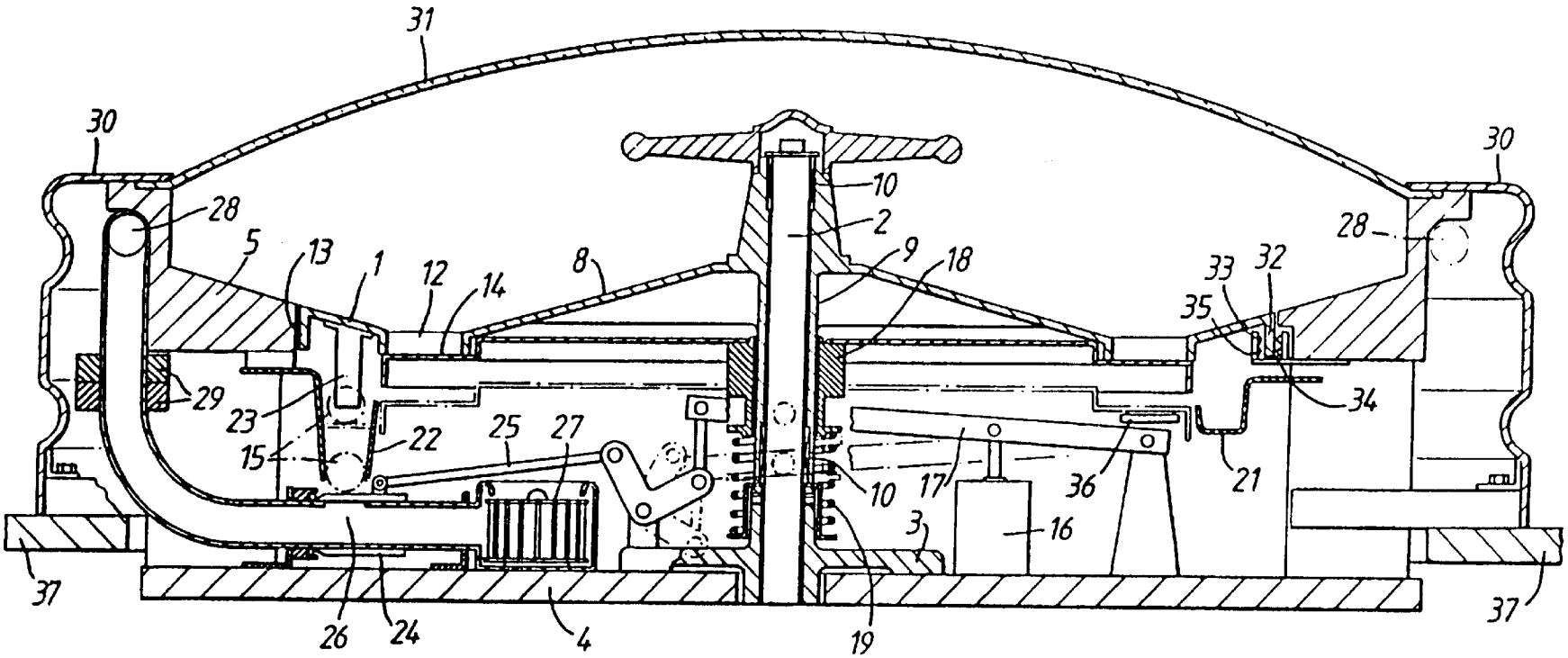
FIG. 4 is a sectional side elevation of a first roulette wheel assembly forming part of the roulette table arrangement of FIGS. 1, 2 and 3.
Figure 5:
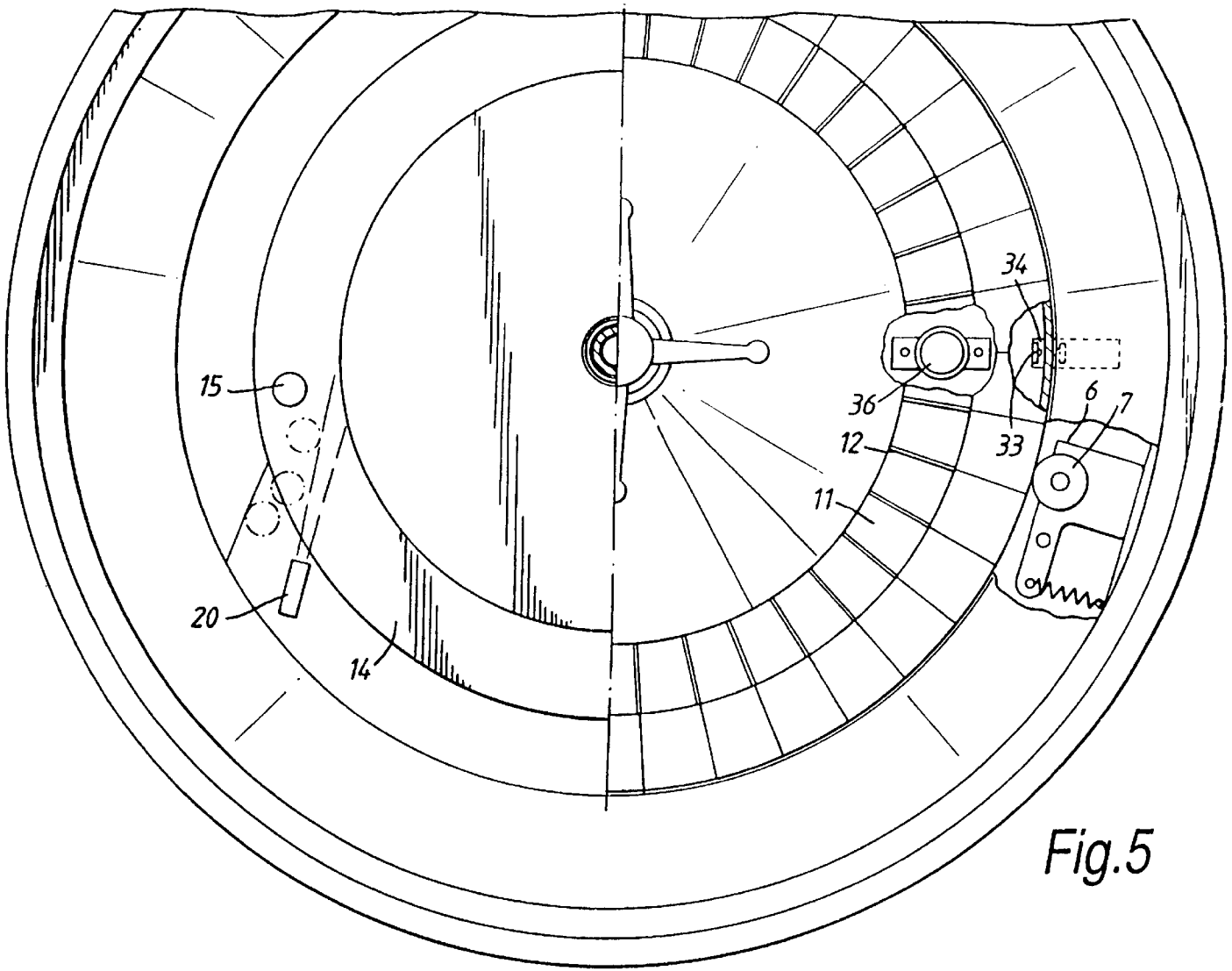
FIG. 5 is a plan view of the roulette wheel assembly of FIG. 4.
Figure 6:
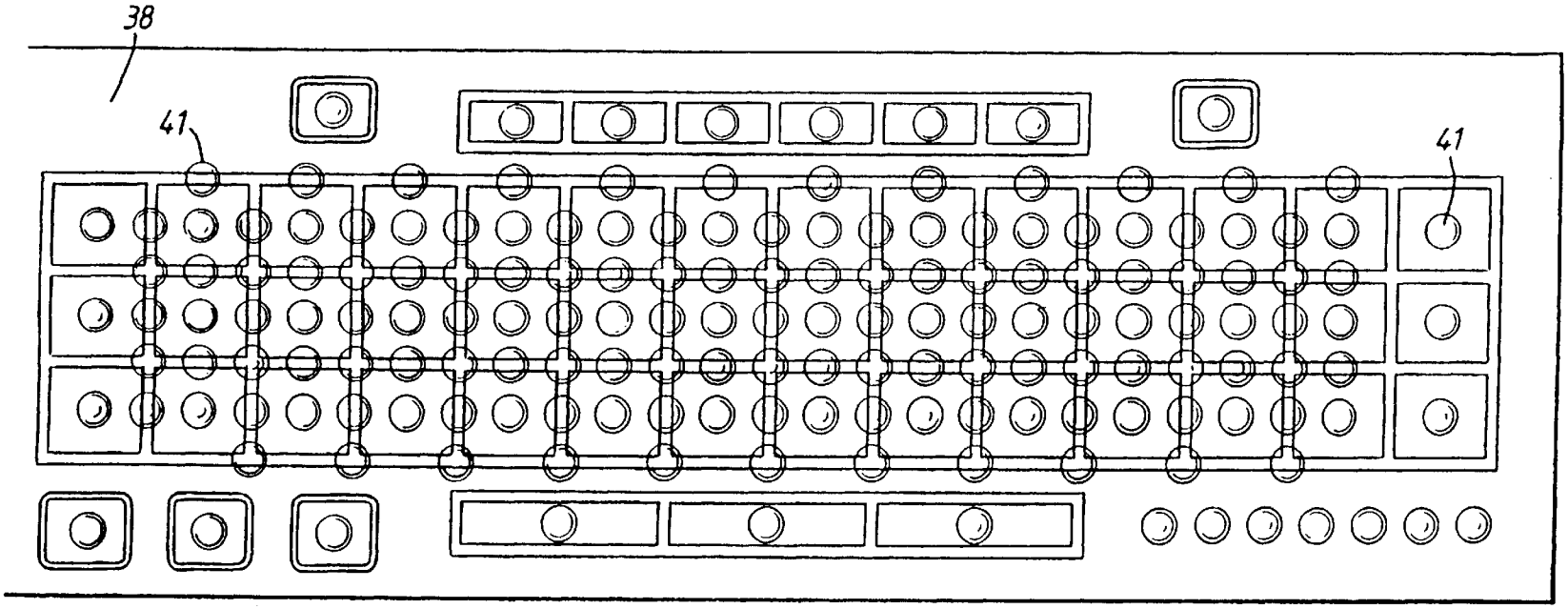
FIG. 6 is a plan view of a player's betting station forming part of the roulette table arrangement of FIGS. 1, 2 and 3.
Figure 7:
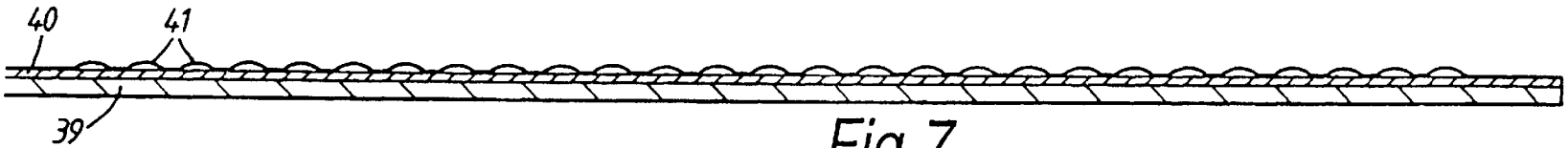
FIG. 7 is a sectional side elevation of the betting station of FIG. 6.
Figure 8:
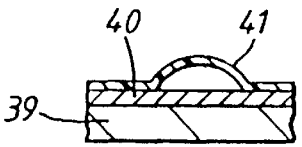
FIG. 8 is a sectional side elevation of an operational switch forming part of the betting station of FIGS. 6 and 7.
Figure 9:
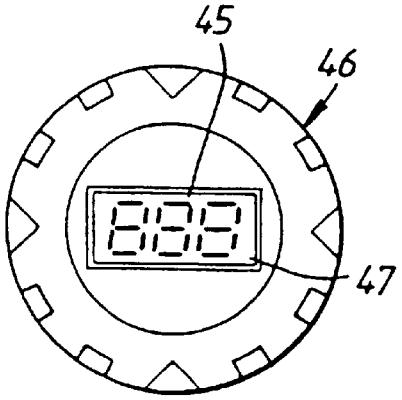
FIG. 9 is a plan view of a casino chip for use with the roulette table arrangement of FIGS. 1, 2 and 3.
Figure 10:
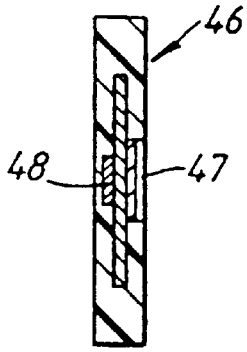
FIG. 10 is a sectional side elevation of the casino chip of FIG. 9.
Figure 11:
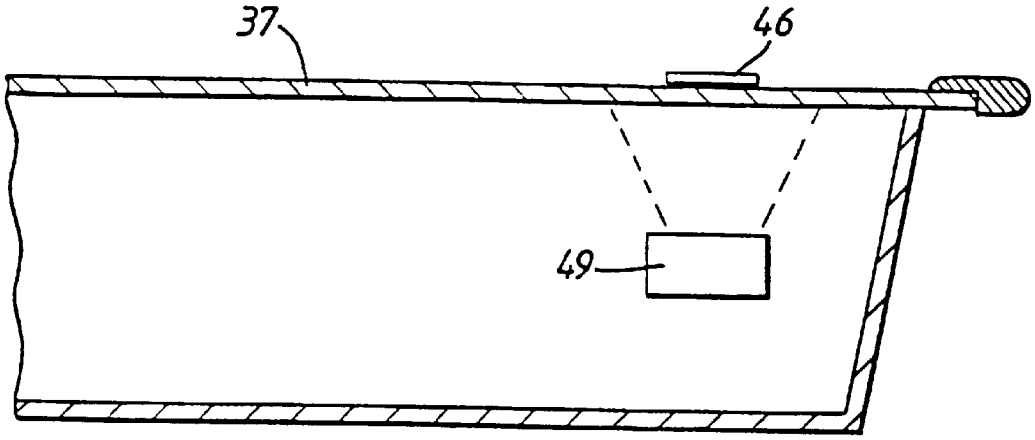
FIG. 11 is a side elevation, partly in section, of part of the roulette table arrangement of FIGS. 1, 2 and 3.

Referring to the drawings, and particularly to FIGS. 4 and 5, a roulette wheel 1 is mounted on a wheel spindle 2 located in a spindle base 3. This spindle is bolted to the center of a bowl frame 4 which supports a wheel bowl 5 surrounding the roulette wheel 1.

A small electric drive motor 6 is spring loaded to retain a rubber drive roller 7 in contact with the side edge of the roulette wheel 1 so as to drive the roulette wheel either clockwise or anti-clockwise as desired.

This drive motor 6 can drive the roulette wheel 1 at any one of a selected range of speeds which are electronically selected.

The spring loaded drive roller 7 ensures that a constant drive pressure is applied to the side edge of the roulette wheel 1 regardless of wheel diameter tolerances or drivewear characteristics. This electric drive motor 6 and rubber drive roller 7 also provide a silent drive to the roulette wheel 1.

A wheel cone 8 contains a bearing housing 9 to locate both the upper and lower wheel bearings 10 on the wheel spindle 2.

Thirty seven slot compartments 11, which are separated by slot dividers 12, are located around the circumference of the roulette wheel 1 to receive a roulette ball 15. The compartment floor 14 of the slot compartments 11 can be lowered to allow the roulette ball 15 to evacuate the roulette wheel 1 in preparation for the next game.

The slot compartments 11 located around the circumference of the roulette wheel 1 are identified by means of numbers, words, colors, symbols or a combination of any of these so that the wheel 1 corresponds to the wheel used in the real game of roulette.

In operation, an electronic signal energizes a progressive solenoid 16 which activates a linkage arm 17 connected to the compartment floor by a dog bush 18 located on the wheel spindle 2. a return spring 19 ensures that the slot compartment floor 14 is in its upper closed position to retain the ball 15 in a slot compartment 11 until the progressive solenoid 16 is activated. When the progressive solenoid 16 is activated the roulette wheel 1 starts to rotate, and the compartment floor 14 is lowered to its lower open position shown in chain line in FIG. 4. Because the compartment floor 14 is perfectly flat, it relies on the centrifugal force of the spinning roulette wheel to throw the roulette ball 15 from the previous game radially outwardly from the wheel 1. In case the roulette ball 15 sticks to the compartment floor 14 an air knife 20 is located at an appropriate angle to ensure that the roulette ball 15 is removed form the wheel 1 by the rotation of the compartment floor 14, as shown in FIG. 5.

Referring particularly to FIG. 4, the roulette ball 15 drops into a collector channel 21, and a ball arm 23 connected to the underside of the wheel rim 13 pushes the roulette ball around the collector channel 21 until the ball 15 drops into a ball magazine 22. These components ensure that from the time that the ball 15 lands in the collector channel 21 the ball is physically moved back to the ball magazine 22 by mechanical means to overcome any sticking or restriction by dust that could otherwise stop the movement of the ball.

The ball magazine 22 contains up to three balls which are of identical diameter and of slightly different weights.

As the linkage arm 17 moves down with the compartment floor 14 it slides open a firing breech 24 via a mechanical linkage 25 thereby allowing a roulette ball 15 to fall into the firing chamber 26. The firing breech 24 is closed and the compartment floor 14 is returned to its upper position to retain the ball in a slot compartment when the linkage arm 17 returns to neutral.

On the appropriate command a small electrically driven air blower 27 blows the roulette ball 15 into the firing tube 28; this air blower 27 having a random number of ball firing air pressures to choose from. The firing tube 28 is dimensioned to allow only enough internal clearance for the ball 15 to move through the tube so as to provide precision control over the random selection of air pressures and movement of the roulette ball 15. This precise dimensioning of the firing tube 28 also means that a miniature air blower 27 can be used and reduces the build up of dust.

A diverting block 29 controls the direction of the firing tube 28, and hence the direction of travel, clockwise or anti-clockwise, of the roulette ball 15 around the wheel bowl 5. The activating signal for the diverting block 29 is transmitted from the same control that controls the direction of rotation of the roulette wheel 1 because the roulette ball 15 will always need to rotate in the opposite direction to the roulette wheel 1.

As shown in FIG. 4, the firing tube 28 is located outside the wheel bowl 5 so that the roulette ball 15 is propelled radially inwardly towards the roulette wheel 1. The outer bowl case 30, which is removable, encloses the working mechanisms of the roulette wheel, and retains a transparent dome 31 over the wheel bowl 5.

When the roulette ball 15 is propelled from the firing tube 28 it travels across the wheel bowl 5 on to the rotating roulette wheel 1 and finally lands in a roulette wheel slot compartment 11.

The wheel floor 14 is flat and the slot compartments 11 are the same size as the compartments in a real roulette wheel to allow the ball 15 the freedom to move around in a free, natural and unbiased manner.

Because the balls 15 have slightly different weights from one another, and because a number of different ball firing pressures are used it is extremely difficult for a player to predict the path followed by the ball when it is propelled from the firing tube 28.

To verify the position of the roulette ball 15 a zero flag 32 under the roulette wheel 1 indicates the angular position of the wheel 1 at the start of every revolution by means of a zero sensor 33. A location slot 34 is positioned around the wheel rim 13 for every slot compartment 11 around the roulette wheel 1. A compartment sensor 35 starts to count the location slots 34 travelling past the start position when triggered by the zero flag 22. A special ball sensor 36 is located on the same radial axis as the compartment sensor 35, and is mounted at a distance below the compartment floor 14 to allow the floor 14 to move downwardly when evacuating the ball 15. The ball sensor 36 detects when the ball 15 has arrived at the radial axis line of the compartment sensor 35. The readings of the sensors 35 and 36 are compared electronically to give the position of the roulette ball 15 on the roulette wheel 1. After verification of the ball's position, the compartment floor 14 is lowered an the described operational cycle is repeated.

Referring particularly to FIGS. 1, 6, 7 and 8, each roulette player around the roulette table 37 has an individual betting station 38 on which is printed a betting layout giving the 152 betting choices that make up the real game of roulette.

Each betting station 38 consists of two laminated materials mounted on a stiffening plate. The lower laminate 40 contains a printed contact circuit layout corresponding to the design of the graphics of the betting layout printed on top of the betting station 38. Of each of the betting choices of the betting layout there is a raised dome 41 representing that choice. When the dome 41 is pressed a contact is bridged with the printed circuit of the lower laminate 40 to activate the electronic circuitry and indicate that a bet has been placed. The raised dome 41 gives the player a positive response that a bet has been placed. The positive response is caused by the positive movement of approximately 1.5 mm with a clicking sound which can be amplified through the player's directional loudspeaker 42. The upper surface of the betting station 38 has a special texture finish so that it feels like the green baize of a standard roulette table. If desired, other game control switches can be added to the betting station 38.

Each betting station 38 is shown on a corresponding video monitor 43 so that when bets are placed by operating an appropriate switch 41 the value of each bet and its position, i.e. the slot number or numbers selected, are clearly shown on the video monitor 43.

To avoid having considerable amounts of money placed on the roulette table the following system using a casino chip is used.

A roulette player pays money over the counter to the casino's bank cashier, and the player is given in return a casino chip 46. This casino chip 46 displays the amount of money 45 handed over by way of a window 47 built into the surface of the chip. Behind the window 47 there is located a smart chip package 48 which has received the injection of the player's credit by electronic transfer operated by the casino cashier. The player places the chip 46 on the roulette table with the window 47 face up to enable the smart chip 48 to make electronic contact with a receive and transmit credit head 49 beneath the table surface.

As the player places bets using the betting station 38 the amount of the bets is subtracted from the original credit shown on the casino chip 46 and the difference is displayed at the window 47. After the winning slot number is announced, the winnings or losses of the player will be added to or subtracted from the player's credit and displayed at the window 47. When the bet is placed by pressing one or more domes 41 a graphic of the casino chip 46 will also appear on the same slot number on the video monitor 43.

Provision is made to give each chip 46 a five-digit display 45 with up to 152 chip displays at any one time shown on the video monitor 43. provision is also made at the top and bottom of the video monitor to allow the display of other information related to the game. When the player wishes to cash his or her winnings, the casino chip is handed back to the cashier at the bank window. After the reading at the window 47 is checked electronically, the appropriate amount of money is paid out to the player.

The above-described embodiment of the invention provides:

(1) A method of playing French or American roulette without the need of a croupier to rotate the roulette wheel or spin the ball.

(2) A design of the roulette wheel which is closely similar to a manually operated roulette wheel in both height and diameter.

(3) A design of wheel compartment slots which allow the roulette ball to move without any restriction, similarly to a manually operated roulette wheel.

(4) A combination of anti-biased systems that are electronically monitored.

(5) A method of tracking the roulette ball.

(6) The method of achieving 152 betting positions on one betting station.

(7) A method of producing a cash-less playing system by means of electronic casino chips with each chip having a value display on the chip surface with the display varying from game to game.

The above-described embodiment of the invention can be applied in a combination of forms, for many variations of the game, and for a small or large number of players using other communication systems.

Figure 12:
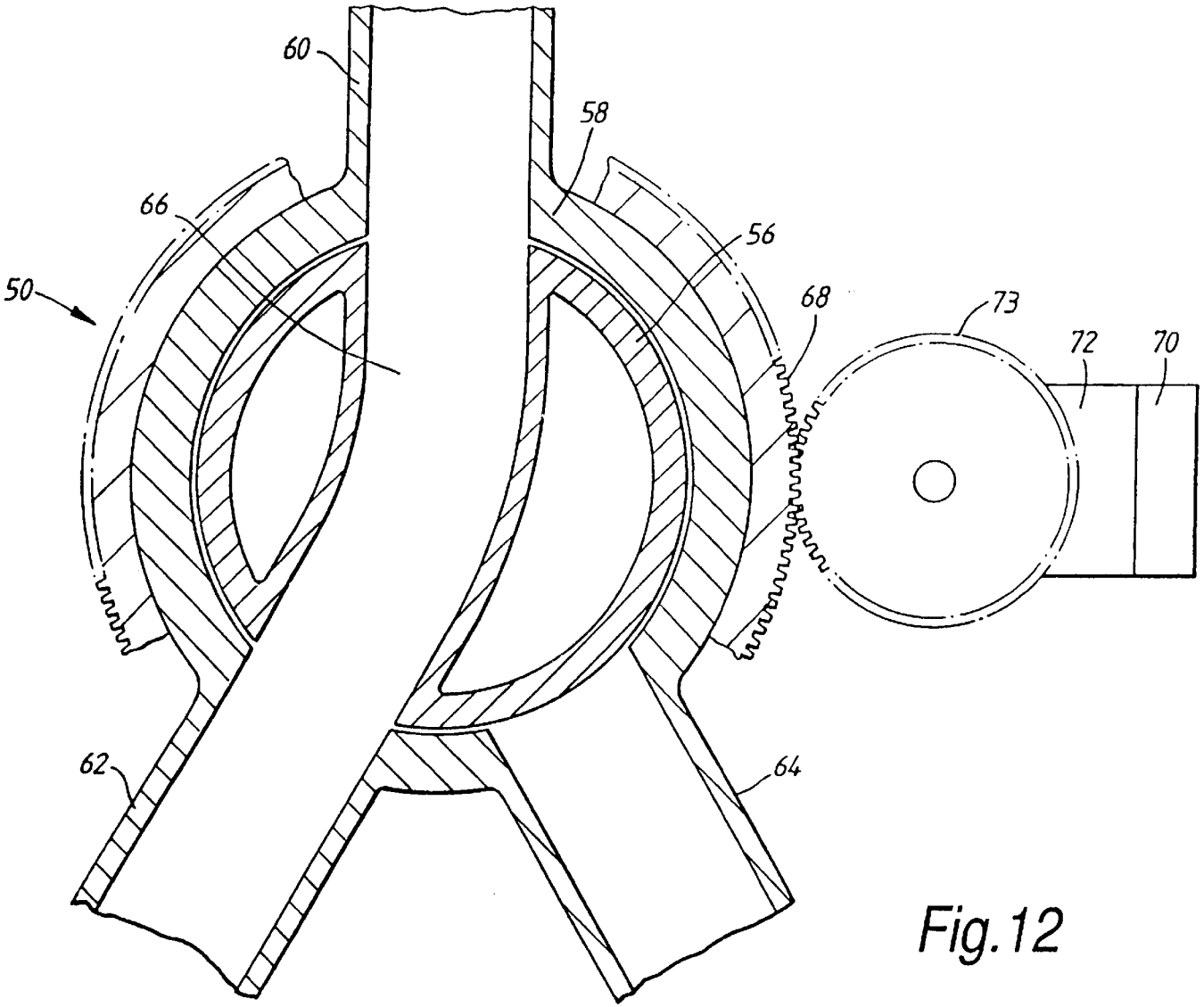
FIG. 12 is a sectional plan view of a valve included in a second roulette wheel assembly of the invention.
Figure 13:
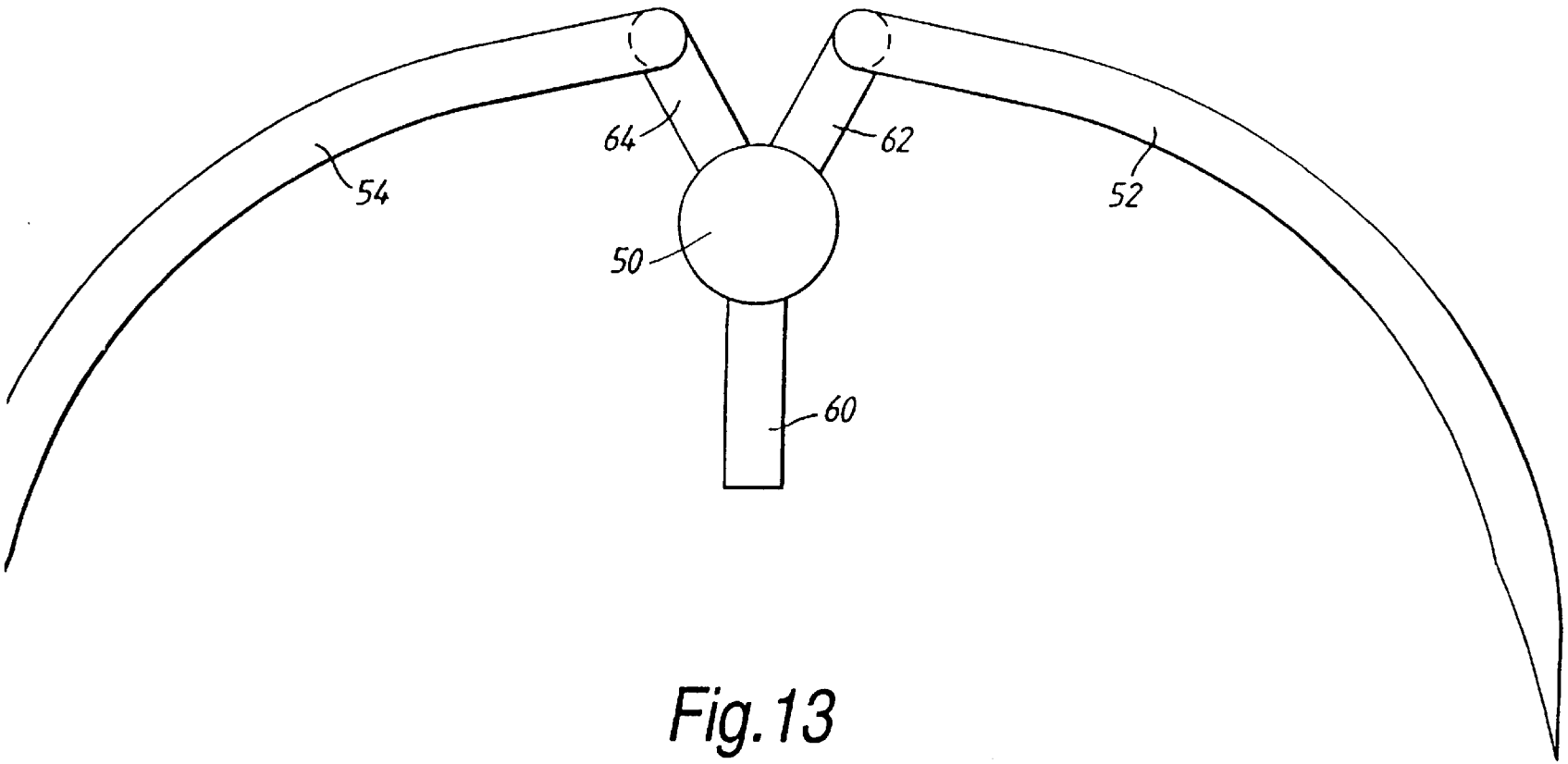
FIG. 13 is a plan view of the valve of FIG. 12 and two firing tubes included in the second assembly.
Figure 14:
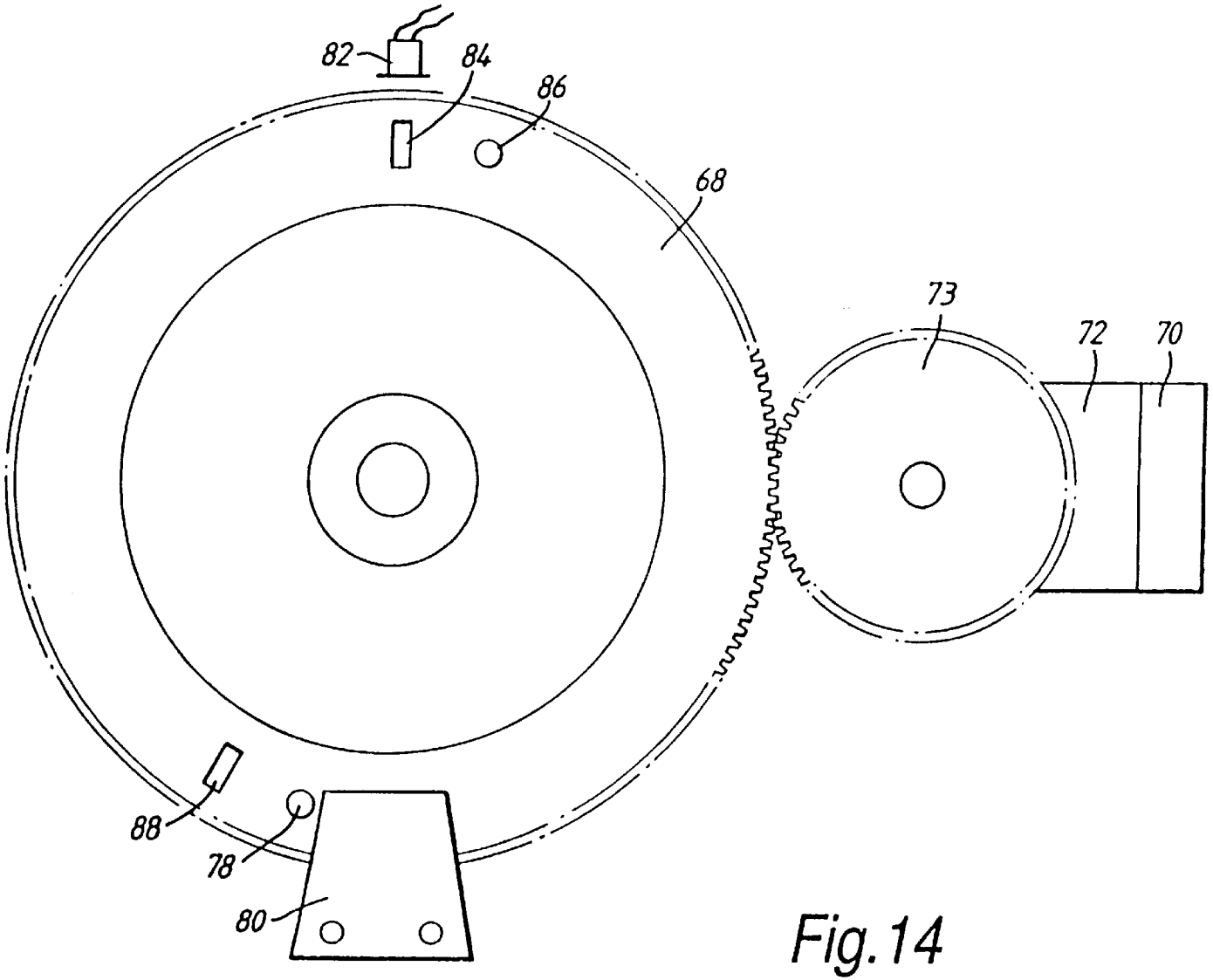
FIG. 14 is a plan view of a sensing means for the valve of FIGS. 12 and 13.

In another embodiment of the invention the firing tube 28 is replaced by a bidirectional valve 50 and two firing tubes 52 and 54 illustrated in FIGS. 12 to 14.

Referring to FIG. 12, the bidirectional valve 50 includes a rotatable vale member 56 rotatably mounted in a valve casing 58. The valve casing 58 includes an inlet passage 60 and two outlet passages 62 and 64. A connecting passage 66 extending through the valve member 56 is shaped to connect the inlet passage 60 with either of the outlet passages 62 and 64.

In the position illustrated in FIG. 12, the connecting passage 66 connects the inlet passage 60 to the outlet passage 62. On rotating the valve member 56 clockwise the connecting passage 66 connects the inlet passage 60 to the outlet passage 64.

The valve member 56 is rotated by a gear wheel 68 mounted on top of the valve casing 58. This gear wheel 68 is driven by an electric motor 70 through a gearbox 72 and a gear pinion 73.

Referring to FIG. 13, the outlet passages 62 and 64 are connected respectively to associated firing tubes 52 and 54 which extend in opposite directions around the outer periphery of the wheel bowl 5 for approximately 90°. The inlet and connecting passages 60 and 66, the passages 62 and 64 and the firing tubes 52 and 54 are all dimensioned to allow only enough internal clearance for the ball 15 to move through the passages and tubes so as to provide precision control over the random selection of air pressures and movement of the roulette ball 15. This precise dimensioning of the tubes and passages also means that a miniature air blower 27 can be used and reduces the build up of dust, as in the above-described first embodiment.

Referring to FIG. 14, on anti-clockwise rotation of the valve member 56 by the gear pinion 73, when the connecting passage 66 is aligned with the inlet passage 60 and the outlet passage 62, the stop pin 78 on the gear wheel 68 abuts a stop block 80 to prevent further rotation of the valve member 56. In this position, la position sensor 82 detects a position slot 84 on the gear wheel 68 to switch off the electric motor 70. On clockwise rotation of the valve member 56 from the above-mentioned position, when the connecting passage 66 is aligned with the inlet passage 60 and the outlet passage 64, a stop pin 86 on the gear wheel 68 abuts the other side of the stop block 80 to prevent further rotation of the gear wheel 68 and the valve member 56. In this position, the position sensor 82 detects a position slot 88 on the gear wheel 68 to switch off the electric motor 70.

In operation, the roulette wheel 1 is rotated, the firing breech 24 is closed with a roulette ball 15 in the firing chamber 26, and the compartment floor 14 is returned to its upper position as describe din the first embodiment. The valve motor 70 is driven to rotate the valve member 565 so that the connecting passage 66 connects the inlet passage 60 with an appropriate one of the outlet passages 62 and 64 to ensure that the roulette ball 15 is propelled from a firing tube 52 or 54 in the opposite direction to the rotation of the roulette wheel 1. For this reason, the activating signal for the motor 70 is transmitted from the same control that controls the direction of rotation of the roulette wheel 1.

The roulette ball 15 is propelled from the appropriate firing tube 52 or 54 tangentially to the outer rim of the wheel bowl 5, and travels across the wheel bowl 5 onto the rotating roulette wheel 1 and finally lands in a roulette wheel slot compartment 11.

What is claimed is:

1. A roulette wheel assembly for a roulette table arrangement, said roulette wheel assembly comprising a rotatable roulette wheel having a plurality of slot compartments around its circumference, a drive motor to rotate the roulette wheel, a firing mechanism to propel a roulette ball onto the rotating roulette wheel which is shaped so that the ball finally lands in a slot compartment, and return mechanism to return the ball from the slot compartment to the firing mechanism characterized in that the floor of each slot compartment is linearly movable between a raised position to retain the ball in the slot compartment and a lowered position to allow the ball to be received by the return mechanism.

2. An assembly as claimed in claim 1, in which the drive motor is operable to rotate the roulette wheel at a selected one of a range of speeds.

3. An assembly as claimed in claim 1, in which a constant drive pressure is applied to the roulette wheel.

4. An assembly as claimed in claim 1 in which the firing mechanism includes a firing tube, and an air blower to propel the roulette ball through the firing tube and onto the roulette wheel.

5. An assembly as claimed in claim 4 in which the air blower is operable to produce a plurality of different ball firing air pressures.

6. An assembly as claimed in claim 4 in which the firing mechanism includes a ball magazine.

7. An assembly as claimed in claim 6 in which the ball magazine is adapted to contain a plurality of balls of different weights.

8. An assembly as claimed in claim 6, in which the return mechanism includes a collector channel to receive the ball from a slot compartment, and director means to direct the ball to the ball magazine.

9. An assembly as claimed in claim 1 in which the action of lowering the slot compartment floor opens a firing breach of the firing mechanism.

10. An assembly as claimed in claim 1 including a sensor mechanism to identify the slot compartment containing the roulette ball.

11. An assembly as claimed in claim 10 in which the sensor mechanism comprises a zero sensor to indicate when the wheel is in a start position, a compartment sensor on a radial axis of the wheel to count the number of slot compartments passing the start position, a ball sensor, on the same radial axis as the compartment sensor, to detect when the ball is located on said radial axis, and electronic circuitry to compare the readings of said zero sensor and ball sensor.

12. An assembly as claimed in claim 1 including two firing tubes extending in opposite directions to propel the roulette ball tangentially with respect to the roulette wheel.

13. An assembly as claimed in claim 12 including a valve member moveable to an operational position connecting the firing mechanism to a selected one of the said two firing tubes.

14. An assembly as claimed in claim 13 including drive means to operate the valve member, and sensing means to switch off the driving means when the valve member is in either one of said operational positions.

15. A roulette table arrangement including a roulette wheel assembly according to claim 1, and at least one betting station containing a roulette betting layout.

16. An arrangement as claimed in claim 15 in which the betting station comprises two laminated materials mounted on a stiffening plate.

17. An arrangement as claimed in claim 16 in which the lower laminate comprises a printed contact circuit layout corresponding to the roulette betting layout at the betting station.

18. An arrangement as claimed in claim 17 comprising raised domes located on and representing at least some of the betting positions of the betting layout whereby pressing the dome activates the printed circuit of the lower laminate to instruct a bet to be placed on that position.

19. An arrangement as claimed in claim 18 in which the dome is constructed so that pressing the dome emits a sound indicating that the bet has been placed.

20. An arrangement as claimed in claim 19 including an amplifier to amplify the sound.

21. A roulette table arrangement according to claim 15 including a video monitor to display the roulette betting layout of a corresponding betting station, and any bets placed thereon.

22. An electronic stake chip in combination with the roulette table arrangement of claim 15 including an indicator to provide a visual display of a player's financial credit at the game.

23. A chip according to claim 22 and a credit head operable so that on placing the chip in electronic contact with the betting station, the chip provides a visual indication of the player's financial credit throughout the game.

* * * * *